US010161023B2

(12) United States Patent
Tanahashi et al.

(10) Patent No.: US 10,161,023 B2
(45) Date of Patent: Dec. 25, 2018

(54) STEEL SHEET FOR HOT STAMPING, METHOD FOR PRODUCTION THEREOF, AND HOT STAMPING STEEL MATERIAL

(71) Applicant: NIPPON STEEL & SUMITOMO METAL CORPORATION, Tokyo (JP)

(72) Inventors: Hiroyuki Tanahashi, Tokyo (JP); Toshimasa Tomokiyo, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 838 days.

(21) Appl. No.: 14/382,704

(22) PCT Filed: Mar. 5, 2013

(86) PCT No.: PCT/JP2013/055992
§ 371 (c)(1),
(2) Date: Sep. 3, 2014

(87) PCT Pub. No.: WO2013/133270
PCT Pub. Date: Sep. 12, 2013

(65) Prior Publication Data

US 2015/0024237 A1 Jan. 22, 2015

(30) Foreign Application Priority Data

Mar. 7, 2012 (JP) ..... 2012-050935

(51) Int. Cl.
*C21D 9/46* (2006.01)
*C22C 38/38* (2006.01)
(Continued)

(52) U.S. Cl.
CPC ..... *C22C 38/38* (2013.01); *B21B 1/26* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS 7,399,535 B2 * 7/2008 Yoshikawa ..... C23C 2/26 428/335
7,842,142 B1 * 11/2010 Kusumi ..... C21D 1/673 148/531
(Continued)

FOREIGN PATENT DOCUMENTS

CA 2231760 A1 9/1999
CN 1553836 A 12/2004
(Continued)

OTHER PUBLICATIONS

Chinese Office Action and Search Report for Chinese Application No. 201380012499.1, dated Sep. 6, 2015, with a partial English translation.
(Continued)

*Primary Examiner* — Daniel J. Schleis
(74) *Attorney, Agent, or Firm* — Birch, Stewart, Kolasch & Birch, LLP

(57) ABSTRACT

A hot stamping steel material, which secures good hydrogen embrittlement resistance even when the steel sheet after hot stamping is subjected to processing leading to remaining of stress, such as piercing and which is easily practicable, wherein the steel sheet has the chemical composition of: C: 0.18 to 0.26%; Si: more than 0.02% and not more than 0.05%; Mn: 1.0 to 1.5%; P: 0.03% or less; S: 0.02% or less; Al: 0.001 to 0.5%; N: 0.1% or less; O: 0.001 to 0.02%; Cr: 0 to 2.0%; Mo: 0 to 1.0%; V: 0 to 0.5%; W: 0 to 0.5%; Ni: 0 to 5.0%; B: 0 to 0.01%; Ti: 0 to 0.5%; Nb: 0 to 0.5%; Cu: 0 to 1.0%; and balance: Fe and impurities, in terms of % by mass, the concentration of a Mn-containing inclusion is not less than 0.010% by mass and less than 0.25% by mass, and
(Continued)

the number ratio of a Mn oxide to the inclusion having a maximum length of 1.0 to 4.0 μm is 10.0% or more.

14 Claims, 2 Drawing Sheets

(51) Int. Cl.

| | |
|---|---|
| ***C23C 2/06*** | (2006.01) |
| ***C23C 2/12*** | (2006.01) |
| ***C23C 2/28*** | (2006.01) |
| ***C23C 2/40*** | (2006.01) |
| ***C22C 38/06*** | (2006.01) |
| ***C22C 38/54*** | (2006.01) |
| ***C22C 38/00*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/18*** | (2006.01) |
| ***C22C 38/28*** | (2006.01) |
| ***C22C 38/32*** | (2006.01) |
| ***B21B 1/26*** | (2006.01) |
| ***C22C 38/08*** | (2006.01) |
| ***C22C 38/16*** | (2006.01) |
| ***C22C 38/22*** | (2006.01) |
| ***C22C 38/24*** | (2006.01) |
| ***C23C 2/02*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/24* (2013.01); *C22C 38/28* (2013.01); *C22C 38/32* (2013.01); *C22C 38/54* (2013.01); *C23C 2/02* (2013.01); *C23C 2/06* (2013.01); *C23C 2/12* (2013.01); *C23C 2/28* (2013.01); *C23C 2/40* (2013.01); *Y10T 428/12757* (2015.01); *Y10T 428/12799* (2015.01)

(56) References Cited

U.S. PATENT DOCUMENTS

| | | | | |
|---|---|---|---|---|
| 8,449,988 | B2 * | 5/2013 | Shiraki | C22C 38/001 428/213 |
| 2001/0001049 | A1 | 5/2001 | Higo et al. | |
| 2003/0196735 | A1 | 10/2003 | Sugiura et al. | |
| 2005/0265886 | A1 | 12/2005 | Hayaishi et al. | |
| 2007/0144632 | A1 | 6/2007 | Toyoda et al. | |
| 2010/0054984 | A1 | 3/2010 | Hashimura et al. | |
| 2011/0174418 | A1 * | 7/2011 | Maki | C21D 8/0205 148/531 |
| 2011/0287280 | A1 * | 11/2011 | Shiraki | C22C 38/001 428/615 |
| 2013/0048161 | A1 | 2/2013 | Matsuda et al. | |

FOREIGN PATENT DOCUMENTS

| | | | |
|---|---|---|---|
| CN | 1782116 | A | 6/2006 |
| CN | 1890394 | A | 1/2007 |
| EP | 2684972 | A1 | 1/2014 |
| JP | 2000-017371 | A | 1/2000 |
| JP | 2002-080933 | A | 3/2002 |
| JP | 2003-166035 | A | 6/2003 |
| JP | 2006-009116 | A | 1/2006 |
| JP | 2006-029977 | A | 2/2006 |
| JP | 2006-37130 | A | 2/2006 |
| JP | 2008-144239 | A | 6/2008 |
| JP | 2010-174291 | A | 8/2010 |
| JP | 2011-184758 | A | 9/2011 |
| JP | 2011168842 | * | 9/2011 |
| KR | 10-2011-0000398 | A | 1/2011 |
| WO | WO 03/024644 | A1 | 3/2003 |
| WO | WO 2007/064172 | A1 | 6/2007 |
| WO | WO 2008/066194 | A1 | 6/2008 |

OTHER PUBLICATIONS

Korean Office Action for Korean Application No. 10-2014-7027737, dated Sep. 10, 2015, with a partial English translation.

International Search Report issued in PCT/JP2013/055992 dated Jun. 11, 2013.

Extended European Search Report for European Application No. 13757523.9, dated Feb. 5, 2016.

European Communication pursuant to Article 94(3) EPC for corresponding European Application No. 13757523.9, dated Aug. 6, 2018.

Brazilian Office Action Publication (Brazilian Industrial Property Journal No. 2493 dated Oct. 16, 2018).

Brazilian Search Report and Office Action dated Oct. 16, 2018, issued in corresponding Brazilian Patent Application No. 112014021801-3.

* cited by examiner

STEEL SHEET FOR HOT STAMPING, METHOD FOR PRODUCTION THEREOF, AND HOT STAMPING STEEL MATERIAL

TECHNICAL FIELD

The present invention relates to a steel sheet for hot stamping, a method for production thereof, and a hot stamping steel material.

BACKGROUND ART

In the field of transportation equipment such as automobiles, an attempt is extensively made to reduce the mass by using high-strength materials. For example, in automobiles, use of high-strength steel sheets has been steadily increased with an intention to improve collision safety and enhance functionality without increasing the car body mass, and also improve fuel efficiency to reduce emissions of carbon dioxide.

In this movement for expansion of use of high-strength steel sheets, the biggest problem is manifestation of a phenomenon called "degradation of shape fixability", which is more likely to occur as the strength of the steel sheet is increased. The phenomenon is more likely to occur as the spring back amount after forming increases with strength enhancement, and the phenomenon causes such an additional problem specific to high-strength steel sheets that it is not easy to obtain a desired shape.

For solving the problem, it is necessary in a usual method for forming a high-strength steel sheet additionally to carry out an unnecessary processing step (e.g. restriking) for a low-strength material free from the problem of degradation of shape fixability, or to change the product shape.

As one method for solving such situations, a hot-forming method called a hot stamping method has received attention. The hot stamping method is a method in which a steel sheet (processed material) is heated to a predetermined temperature (generally the temperature that serves as an austenite phase), and stamped by a die having a temperature (e.g. room temperature) lower than the temperature of the processed material with the strength of the processed material decreased for facilitating forming, whereby a desired shape can be easily provided, and also a rapid cooling heat treatment (quenching) using a difference in temperature between the processed material and the pressing is performed to increase the strength of a product after forming.

In recent years, the hot stamping method has been recognized for its usefulness, and a wide range of steel materials have been considered to be applied. Examples thereof include steel materials that are used under a severe corrosive environment, like automobile undercarriage components, and steel materials provided with perforated portions for the purpose of joining other components. Thus, steel materials obtained by the hot stamping method have been required to have not only strength but also hydrogen embrittlement resistance.

This is because while it is generally known that hydrogen embrittlement resistance is reduced with strength enhancement of steel materials, a steel material obtained by the hot stamping method generally has high strength, and therefore in application of the hot stamping method to the steel material, the steel material is exposed to a corrosive environment to accelerate ingress of hydrogen into the steel, and massive residual stress occurs as processing such as punching is performed, thus raising the possibility that hydrogen embrittlement occurs.

From such a viewpoint, a technique intended to secure hydrogen embrittlement resistance has also been proposed for steel materials whose strength is enhanced by the hot stamping method. For example, Patent Literature 1 discloses a technique concerning a steel sheet having resistance to delayed rupture (the same meaning as hydrogen embrittlement resistance) by including at a predetermined density one or more of oxides, sulfides, composite crystallized products and composite precipitated products of Mg having an average particle size in a predetermine range. Patent Literature 2 discloses a technique in which the punching characteristic is improved by performing punching (perforation) in a high-temperature state (hot) after heating for hot stamping and before pressing, so that delayed rupture resistance is improved.

PRIOR ART LITERATURES

Patent Literatures

[Patent Literature 1] JP2006-9116A
[Patent Literature 2] JP2010-174291A
[Patent Literature 3] JP2006-29977A

SUMMARY OF THE INVENTION

Problems to Be Solved by the Invention

Although the technique disclosed in Patent Literature 1 is an excellent technique, but it is a technique in which Mg that is not easily included in general is made to exist in the steel, and a product containing Mg is highly controlled. Therefore, a more easily practicable technique is desired.

The technique disclosed in Patent Literature 2 is a technique based on hot perforation in which punching (perforation) is performed in a high-temperature state (hot) after heating for hot stamping and before pressing. Accordingly, high dimensional accuracy cannot be secured in a steel material after hot stamping. Further, the shape capable of being formed by the technique is restricted. Therefore, it is difficult to expand the range of applications (components) of the hot stamping method by the technique disclosed in Patent Literature 2.

Thus, there has not been proposed a technique which secures good hydrogen embrittlement resistance even when processing leading to remaining of stress, such as perforation, is performed after hot stamping and which is easily practicable.

Accordingly, an object of the present invention is to provide a steel sheet for hot stamping, which secures good hydrogen embrittlement resistance even when a steel material after hot stamping is subjected to processing leading to remaining of stress, such as perforation; a method for production thereof which can easily be performed; and a hot stamping steel material.

Means for Solving the Problems

For achieving the object described above, the present inventors have extensively conducted studies as described below. The present inventors have given attention to a Mn-containing inclusion and a Mn oxide which are relatively easily generated in the steel, and come up with a new idea of securing good hydrogen embrittlement resistance by making these substances serve as a trap site for diffusible hydrogen and non-diffusible hydrogen.

Then, steel sheets for hot stamping have been prepared under various conditions and subjected to a hot stamping method, and for the obtained steel materials, strength and ductility as fundamental characteristics as well as hydrogen embrittlement resistance and toughness have been examined. As a result, it has been newly found that good hydrogen embrittlement resistance can be secured in the steel material after hot stamping by increasing the concentration of the Mn-containing inclusion and the number ratio of the Mn oxide to the Mn-containing inclusion having a predetermined size.

On the other hand, such a problem has been newly found that when the concentration of the Mn-containing inclusion is excessively increased, a reduction in toughness becomes apparent in the steel material after hot stamping. That is, it has been newly found when the concentration of the Mn-containing inclusion falls within a predetermined range and the number density of the Mn oxide to the Mn-containing inclusion having a predetermined size is equal to or greater than a predetermined value, good hydrogen embrittlement resistance can be secured and good toughness can be secured even when the steel material after hot stamping is subjected to processing leading to remaining of stress, such as punching.

Then, it has been newly found that by increasing the coiling temperature in a hot rolling step as compared to conventional techniques and performing cold rolling in conditions for production of the steel sheet for hot stamping, the concentration of the Mn-containing inclusion can be made fall within a predetermined range and the number ratio of the Mn oxide to the Mn-containing inclusion having a predetermined size can be made equal to or greater than a predetermined value.

The present invention has been devised based on the above-described new findings, and the subject thereof is as follows.

(1) A steel sheet for hot stamping, wherein the steel sheet has the chemical composition of: C: 0.18 to 0.26%; Si: more than 0.02% and not more than 0.05%; Mn: 1.0 to 1.5%; P: 0.03% or less; S: 0.02% or less; Al: 0.001 to 0.5%; N: 0.1% or less; O: 0.0010 to 0.020%; Cr: 0 to 2.0%; Mo: 0 to 1.0%; V: 0 to 0.5%; W: 0 to 0.5%; Ni: 0 to 5.0%; B: 0 to 0.01%; Ti: 0 to 0.5%; Nb: 0 to 0.5%; Cu: 0 to 1.0%; and balance: Fe and impurities, in terms of % by mass, the concentration of a Mn-containing inclusion is not less than 0.010% by mass and less than 0.25% by mass, and the number ratio of a Mn oxide to the inclusion having a maximum length of 1.0 to 4.0 μm is 10.0% or more.

(2) The steel sheet for hot stamping according to (1), wherein the chemical composition includes one or more selected from the group consisting of Cr: 0.01 to 2.0%; Mo: 0.01 to 1.0%; V: 0.01 to 0.5%; W: 0.01 to 0.5%; Ni: 0.01 to 5.0%; and B: 0.0005 to 0.01%, in terms of % by mass.

(3) The steel sheet for hot stamping according to (1) or (2), wherein the chemical composition includes one or more selected from the group consisting of Ti: 0.001 to 0.5%; Nb: 0.001 to 0.5%; and Cu: 0.01 to 1.0%, in terms of % by mass.

(4) The steel sheet for hot stamping according to any one of (1) to (3), wherein the steel sheet includes on a surface thereof an aluminum hot-dipping layer having a thickness of 50 μm or less.

(5) The steel sheet for hot stamping according to any one of (1) to (3), wherein the steel sheet includes on a surface thereof a hot-dip galvanized layer having a thickness of 30 μm or less.

(6) The steel sheet for hot stamping according to any one of (1) to (3), wherein the steel sheet includes on a surface thereof an alloyed hot-dip galvanized layer having a thickness of 45 μm or less.

(7) A method for production of a steel sheet for hot stamping, the method including: a hot rolling step of hot-rolling a steel piece having the chemical composition of: C: 0.18 to 0.26%; Si: more than 0.02% and not more than 0.05%; Mn: 1.0 to 1.5%; P: 0.03% or less; S: 0.02% or less; Al: 0.001 to 0.5%; N: 0.1% or less; O: 0.0010 to 0.020%; Cr: 0 to 2.0%; Mo: 0 to 1.0%; V: 0 to 0.5%; W: 0 to 0.5%; Ni: 0 to 5.0%; B: 0 to 0.01%; Ti: 0 to 0.5%; Nb: 0 to 0.5%; Cu: 0 to 1.0%; and balance: Fe and impurities, in terms of % by mass, and then coiling the steel piece at a temperature of 690° C. or higher to form a hot-rolled steel sheet; and a cold rolling step of cold-rolling the hot-rolled steel sheet at a draft of 10 to 90% to form a cold-rolled steel sheet.

(8) The method for production of a steel sheet for hot stamping according to (7), wherein the chemical composition includes one or more selected from the group consisting of Cr: 0.01 to 2.0%; Mo: 0.01 to 1.0%; V: 0.01 to 0.5%; W: 0.01 to 0.5%; Ni: 0.01 to 5.0%; and B: 0.0005 to 0.01%, in terms of % by mass.

(9) The method for production of a steel sheet for hot stamping according to (7) or (8), wherein the chemical composition includes one or more selected from the group consisting of Ti: 0.001 to 0.5%; Nb: 0.001 to 0.5%; and Cu: 0.01 to 1.0%, in terms of % by mass.

(10) A method for production of a steel sheet for hot stamping, wherein the steel sheet for hot stamping, which is obtained by the production method according to any one of (7) to (9), is immersed in an aluminum hot-dipping bath to form an aluminum hot-dipping layer on the surface of the steel sheet.

(11) A method for production of a steel sheet for hot stamping, wherein the steel sheet for hot stamping, which is obtained by the production method according to any one of (7) to (9), is immersed in a hot-dip galvanizing bath to form a hot-dip galvanized layer on the surface of the steel sheet.

(12) A method for production of a steel sheet for hot stamping, wherein the steel sheet for hot stamping, which is obtained by the production method according to any one of (7) to (9), is immersed in a hot-dip galvanizing bath, and then heated at a temperature of 600° C. or lower to form an alloyed hot-dip galvanized layer on the surface of the steel sheet.

(13) A hot stamping steel material, wherein the hot stamping steel material has the chemical composition of: C: 0.18 to 0.26%; Si: more than 0.02% and not more than 0.05%; Mn: 1.0 to 1.5%; P: 0.03% or less; S: 0.02% or less; Al: 0.001 to 0.5%; N: 0.1% or less; O: 0.0010 to 0.020%; Cr: 0 to 2.0%; Mo: 0 to 1.0%; V: 0 to 0.5%; W: 0 to 0.5%; Ni: 0 to 5.0%; B: 0 to 0.01%; Ti: 0 to 0.5%; Nb: 0 to 0.5%; Cu: 0 to 1.0%; and balance: Fe and impurities, in terms of % by mass, the concentration of a Mn-containing inclusion is not less than 0.010% by mass and less than 0.25% by mass, and the number ratio of a Mn oxide to the inclusion having a maximum length of 1.0 to 4.0 μm is 10.0% or more.

(14) The hot stamping steel material according to the above (13), wherein the chemical composition includes one or more selected from the group consisting of Cr: 0.01 to 2.0%; Mo: 0.01 to 1.0%; V: 0.01 to 0.5%; W: 0.01 to 0.5%; Ni: 0.01 to 5.0%; and B: 0.0005 to 0.01%, in terms of % by mass.

(15) The hot stamping steel material according to (13) or (14), wherein the chemical composition includes one or more selected from the group consisting of Ti: 0.001 to 0.5%; Nb: 0.001 to 0.5%; and Cu: 0.01 to 1.0%, in terms of % by mass.

Effects of the Invention

According to the present invention, good hydrogen embrittlement resistance can be secured even when processing leading to remaining of stress, such as punching, is performed after hot stamping, and practice is easy, so that the range of applications (components) of the hot stamping method can be expanded.

MODES FOR CARRYING OUT THE INVENTION

(1) Chemical Composition

Figure 1:
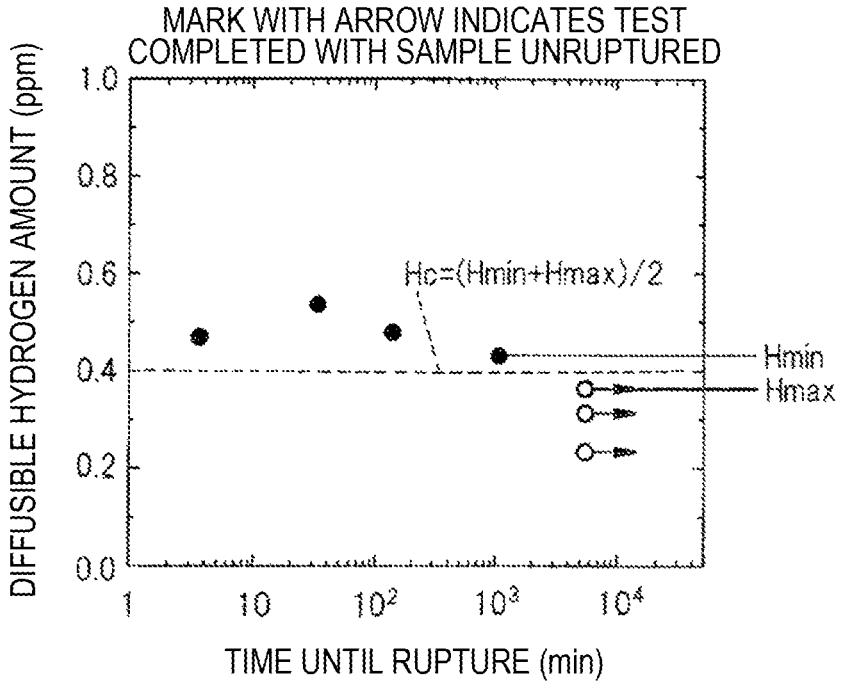
FIG. 1 is a view illustrating a relationship between the amount of diffusible hydrogen and the time until rupture.

The reason for specifying the chemical compositions of a steel sheet for hot stamping (hereinafter, also referred to as the "present invention steel sheet") and a hot stamping steel material (hereinafter, also referred to as the "present invention steel material") according to the present invention will be described. The "%" in the following descriptions means "% by mass".

<C: 0.18 to 0.26%>

C is an element that is the most important in increasing the strength of a steel sheet by a hot stamping method. When the C content is less than 0.18%, it is difficult to secure a strength of 1500 MPa or more after hot stamping. Therefore, the C content is 0.18% or more.

On the other hand, when the C content is more than 0.26%, ductility after hot stamping becomes poor and it is difficult to secure a total elongation of 10% or more. Therefore, the C content is 0.26% or less.

<Si: More than 0.02% and not More than 0.05%>

Si is an element that is important in controlling the concentration of a Mn-containing inclusion and the number ratio of a Mn oxide to the inclusion having a maximum length of 1.0 to 4.0 μm. When the Si content is 0.02% or less, generation of the Mn oxide is excessively accelerated, and the concentration of the Mn-containing inclusion reaches 0.25% or more, so that toughness may be significantly reduced. Therefore, the Si content is more than 0.02%. On the other hand, when the Si content is more than 0.05%, generation of the Mn oxide is excessively suppressed, and the number ratio of the Mn oxide to the Mn-containing inclusion having a maximum length of 1.0 to 4.0 μm is less than 10.0%, so that it is difficult to obtain good hydrogen embrittlement resistance with stability. Therefore, the Si content is 0.05% or less.

<Mn: 1.0 to 1.5%>

Mn is an element that is the most important in the present invention. Mn acts to enhance hydrogen embrittlement resistance by forming a Mn-containing inclusion in the steel. Remaining Mn that has not formed the inclusion acts to enhance hardenability. When the Mn content is less than 1.0%, it is difficult to ensure that the concentration of the Mn-containing inclusion is 0.010% by mass or more. Therefore, the Mn content is 1.0% or more. On the other hand, when the Mn content is more than 1.5%, the effect from the above-mentioned action is saturated, thus being economically disadvantageous, and mechanical characteristics may be deteriorated due to segregation of Mn. Therefore, the Mn content is 1.5% or less.

<P: 0.03% or Less>

P is an element that is generally contained as an impurity. When the P content is more than 0.03%, hot processability is significantly deteriorated. Therefore, the P content is 0.03% or less. The lower limit of the P content does not have to be particularly specified, but is preferably 0.001% or more because excessive reduction causes a considerable burden on the steel-making process.

<S: 0.02% or Less>

S is an element that is generally contained as an impurity. When the S content is more than 0.02%, hot processability is significantly deteriorated. Therefore, the S content is 0.02% or less. The lower limit of the S content does not have to be particularly specified, but is preferably 0.0005% or more because excessive reduction causes a considerable burden on the steel production process.

<Al: 0.001 to 0.5%>

Al is an element that acts to consolidate the steel by deoxidization. When the Al content is less than 0.001%, it is difficult to perform sufficient deoxidization. Therefore, the Al content is 0.001% or more. On the other hand, when the Al content is more than 0.5%, generation of the Mn oxide is excessively suppressed, and it is difficult to secure the later-described Mn oxide ratio, so that it is difficult to secure good hydrogen embrittlement resistance. Therefore, the Al content is 0.5% or less.

<N: 0.1% or Less>

N is an element that is generally contained as an impurity. When the N content is more than 0.1%, N is easily bound with Ti and B which are the later-described optional elements to consume the elements, so that the effects of these elements are reduced. Therefore, the N content is 0.1% or less, preferably 0.01% or less. The lower limit of the N content does not have to be particularly specified, but is preferably 0.001% or more because excessive reduction causes a considerable burden on the steel-making step.

<O: 0.0010 to 0.020%>

O forms a Mn oxide in the steel, which acts to enhance hydrogen embrittlement resistance by serving as a trap site for diffusible hydrogen and non-diffusible hydrogen. When the O content is less than 0.0010%, generation of the Mn oxide is not sufficiently accelerated, and the number ratio of the Mn oxide to the Mn-containing inclusion is less than 10.0%, so that good hydrogen embrittlement resistance cannot be obtained with stability. Therefore, the O content is 0.0010% or more. On the other hand, when the O content is more than 0.020%, a coarse oxide is formed in the steel to degrade mechanical characteristics of the steel material. Therefore, the O content is 0.020% or less.

The present invention steel sheet and the present invention steel material have the above-described components as an essential component composition, and may further contain one or more of Cr, Mo, V, W, Ni, B, Ti, Nb and Cu as necessary.

<Cr: 0 to 2.0%>, <B: 0 to 0.01%>, <Mo: 0 to 1.0%>, <W: 0 to 0.5%>, <V: 0 to 0.5%> and <Ni: 0 to 5.0%>

These elements all act to enhance hardenability. Therefore, one or more of these elements may be contained.

However, when B is contained in an amount exceeding the above-mentioned upper limit, hot processability is degraded and ductility is reduced. When Cr, Mo, W, V and Ni are contained in an amount exceeding the above-mentioned upper limit, the effect from the above-mentioned action is saturated, thus being economically disadvantageous. Therefore, the upper limits of the contents of B, Cr, Mo, W, V and Ni are each as described above. For more reliably obtaining the effect from the above-mentioned action, it is preferred that the B content is 0.0005% or more, or the content of any of Cr, Mo, W, V and Ni elements is 0.01% or more. Ni acts to suppress degradation of the surface property of the hot-rolled steel sheet by Cu, and therefore it is preferred that Ni is also contained when later-described Cu is contained.

<Ti: 0 to 0.5%>, <Nb: 0 to 0.5%> and <Cu: 0 to 1.0%>

Ti, Nb and Cu all act to increase strength. Therefore, one or more of these elements may be contained. However, when the Ti content is more than 0.5%, generation of the Mn oxide is excessively suppressed, and it is difficult to secure the later-described Mn oxide ratio, so that it is difficult to secure good hydrogen embrittlement resistance. Therefore, the Ti content is 0.5%. When the Nb content is more than 0.5%, controllability of hot rolling may be impaired. Therefore, the Nb content is 0.5% or less. When the Cu content is more than 1.0%, the surface property of the hot-rolled steel sheet may be impaired. Therefore, the Cu content is 1.0% or less. For obtaining the effect from the above-mentioned action more reliably, it is preferred that any of Ti (0.001% or more), Nb (0.001% or more) and Cu (0.01% or more) is contained. Since Ti is preferentially bound with N in the steel to form a nitride, and thereby inhibits B from being wastefully consumed by forming a nitride, so that the effect by B can be further increased, it is preferred that Ti is also contained when the above-mentioned B is contained.

The balance includes Fe and impurities.

(2) Inclusion

Next, the reason for specifying the concentration of the Mn-containing inclusion and the number ratio of the Mn oxide to the Mn-containing inclusion having a maximum length of 1.0 to 4.0 μm in the present invention steel sheet and the present invention steel material will be described.

<Concentration of Mn-Containing Inclusion: Not Less than 0.010% by Mass and Less than 0.25% by Mass>

The Mn-containing inclusion plays an important role in suppression of hydrogen embrittlement together with the number ratio of the Mn oxide to the later-described Mn-containing inclusion having a maximum length of 1.0 to 4.0 μm. When the concentration of the Mn-containing inclusion is less than 0.010%, it is difficult to obtain good hydrogen embrittlement resistance. Therefore, the concentration of the Mn-containing inclusion is 0.010% or more. On the other hand, when the concentration of the Mn-containing inclusion is 0.25% or more, toughness may be reduced. Therefore, the concentration of the Mn-containing inclusion is less than 0.25%.

The concentration of the Mn-containing inclusion is determined in accordance with the following procedure. That is, a steel sheet is electrolyzed at a constant current in an electrolytic solution with acetylacetone and tetramethylammonium dissolved in methanol, a filter having a pore diameter of 0.2 μm is used to collect residues, the mass of the residues is divided by an electrolysis amount (mass of the steel sheet lost by electrolysis), and the obtained value is multiplied by 100 to be described in terms of a percentage. It is confirmed that the inclusion extracted by the electrolysis method contains Mn by EDS (energy dispersive X-ray spectroscopy) with a SEM (scanning electron microscope).

<Number Ratio of Mn Oxide to Number of Mn-Containing Inclusions Having Maximum Length of 1.0 to 4.0 μm: 10.0% or More>

The number ratio of the Mn oxide to the Mn-containing inclusion having a maximum length of 1.0 to 4.0 μm plays an important role in suppression of hydrogen embrittlement together with the Mn-containing inclusion described above. When the number ratio of the Mn oxide to the number of Mn-containing inclusions having a maximum length of 1.0 to 4.0 μm is less than 10.0%, it is difficult to obtain good hydrogen embrittlement resistance. Therefore, the number ratio of the Mn oxide to the number of Mn-containing inclusions having a maximum length of 1.0 to 4.0 μm is 10.0% or more.

The number ratio of the Mn oxide to the number of Mn-containing inclusions having a maximum length of 1.0 to 4.0 μm is determined in accordance with the following procedure. The cross section of a steel sheet is observed with a SEM, and inclusions having a maximum length (e.g. the length of the longer side when the inclusion is rectangular, and the length of the major axis when the inclusion is elliptical) of 1.0 to 4.0 μm are selected, and defined as examination objects. These inclusions are subjected to EDS analysis, and those for which a characteristic X-ray from Mn and a characteristic X-ray from O (oxygen) are detected at the same time are judged as the Mn oxide. Observation/analysis is performed in a plurality of visual fields until the total number of examined objects exceeds 500, and the number ratio of the Mn oxide to the total number of examined objects is defined as a number ratio of the Mn oxide.

Here, the reason why the maximum length of inclusions to be examined is 1.0 μm or more is that with a smaller inclusion, accuracy of analysis of constituent elements by EDS becomes insufficient. Here, the reason why the maximum length of inclusions to be examined is 4.0 μm or less is that a larger inclusion is a union etc. of a plurality of different inclusions, so that constituent elements (combinations thereof) are not uniquely defined by EDS analysis sites.

(3) Plating Layer

The present invention steel sheet and the present invention steel material may be a surface-treated steel sheet or a surface-treated steel material with plating layer formed on a surface thereof for the purpose of improvement of corrosion resistance, etc. The plating layer may be hot-dipping layer or may be an electroplating layer. Examples of the hot-dipping layer include hot-dip galvanized layers, alloyed hot-dip galvanized layers, aluminum hot-dipping layers, Zn—Al alloy hot-dipping layers, Zn—Al—Mg alloy hot-dipping layers and Zn—Al—Mg—Si alloy hot-dipping layers. Examples of the electroplating layer include zinc-electroplating layers and Zn—Ni alloy-electroplating layers.

The thickness of the plating layer is not particularly limited from the viewpoint of hydrogen embrittlement resistance and toughness. For the present invention steel sheet, however, it is preferred to restrict the upper limit of the thickness of the plating layer from the viewpoint of press formability. For example, the thickness of the plating layer is preferably 50 μm or less from the viewpoint of galling resistance in the case of aluminum hot-dipping, the thickness of the plating layer is preferably 30 μm or less from the viewpoint of suppressing adhesion of Zn to a die in the case of hot-dip galvanizing, and the thickness of the plating layer is preferably 45 μm or less from the viewpoint of suppressing occurrence of cracking of an alloy layer in the case of alloying hot-dip galvanizing. On the other hand, it is preferred to restrict the lower limit of the thickness of the plating layer from the viewpoint of corrosion resistance. For example, in the case of aluminum hot-dipping and hot-dip galvanizing, the thickness of the plating layer is preferably 5 μm or more, more preferably 10 μm or more. In the case of alloying hot-dip galvanizing, the thickness of the plating layer is preferably 10 μm or more, more preferably 15 μm or more.

(4) Method for Production of Present Invention Steel Sheet

A method for production of the present invention steel sheet will be described. The present invention steel sheet can be produced by a production method including: a hot rolling step of hot-rolling a steel piece having the above-mentioned chemical composition, and then coiling the steel piece at a temperature of 690° C. or higher to form a hot-rolled steel sheet; and a cold rolling step of cold-rolling the hot-rolled steel sheet at a draft of 10 to 90% to form a cold-rolled steel sheet. Here, steel-making conditions and casting conditions in production of the steel piece and conditions for cold rolling applied to the hot-rolled steel sheet may conform to a usual method. Pickling performed before cold-rolling the hot-rolled steel sheet may conform to a usual method.

The form of the inclusion described above is obtained by hot-rolling a steel piece having the above-mentioned chemical composition, then coiling the steel piece at a temperature of 690° C. or higher to form a hot-rolled steel sheet, and cold-rolling the hot-rolled steel sheet at a draft of 10 to 90%. Therefore, recrystallization annealing after cold rolling is not necessary from the viewpoint of hydrogen embrittlement resistance and toughness after hot stamping. However, it is preferred that after cold rolling, recrystallization annealing is performed to soften the steel sheet from the viewpoint of processability of blanking and pre-forming etc. which are performed before the steel sheet is subjected to hot stamping. A plating layer may be provided after recrystallization annealing for the purpose of improvement of corrosion resistance, etc. When the hot-dipping is performed, it is preferred to perform hot-dipping treatment performed using continuous hot-dipping equipment subsequent to recrystallization annealing.

The reason why a steel sheet for hot stamping, which is capable of providing a hot stamping steel material having good hydrogen embrittlement resistance and toughness, is obtained by the above-described production method is not necessarily evident, but this is considered to be related to a generation state of cementite and a microstructure in the hot-rolled steel sheet before being subjected to cold rolling. That is, cementite is crushed together with other inclusions in the cold rolling step as a post-step of the hot rolling step, but depending on a size thereof, the size and the dispersion state after crushing and a generation state of gaps between the cementite and the steel vary. Depending on the strength (hardness) of the microstructure, the hardness difference between the microstructure and the inclusion varies, and this also affects the state of the inclusion and gaps. Moreover, both the cementite and microstructure affect the state of inclusions that are not crushed but deformed.

The present inventors presume that by hot-rolling a steel piece having the above-mentioned chemical composition and then coiling the steel piece at a temperature of 690° C. or higher, and cold-rolling the thus obtained hot-rolled steel sheet at a draft of 10 to 90%, a generation state of cementite and a microstructure are exquisitely combined, and as a result, the form of the inclusion described above can be secured, so that good hydrogen embrittlement resistance and toughness can be obtained.

The upper limit of the coiling temperature is not particularly restricted from the viewpoint of securing both hydrogen embrittlement resistance and toughness. However, the coiling temperature is preferably 850° C. or lower from the viewpoint of suppressing an increase in crystal grain size of the hot-rolled steel sheet to reduce anisotropy of mechanical properties such as stretchability or suppressing an increase in scale thickness to reduce a burden of pickling. The draft in the cold rolling step may be appropriately selected according to a capacity of equipment and a sheet thickness of the hot-rolled steel sheet.

Production conditions other than those described above have little influence on hydrogen embrittlement resistance and toughness. For example, in the hot rolling step, a temperature of 1200 to 1250° C. as a temperature of the steel piece subjected to hot rolling, a draft of 30 to 90%, and a finishing temperature of around 900° C. may be selected.

When recrystallization annealing is performed, the annealing temperature is desired to be 700 to 850° C. from the viewpoint of moderately softening the steel sheet, but for the purpose of characterizing other mechanical properties, the annealing temperature may be lower than 700° C., or may be higher than 850° C. After recrystallization annealing, the steel sheet may be directly cooled to room temperature, or may be immersed in a hot-dipping bath in the process of cooling to room temperature to form a hot-dipping layer on the surface of the steel sheet.

When hot-dipping is aluminum hot-dipping, Si may be contained in a concentration of 0.1 to 20% in an aluminum hot-dipping bath. Si contained in the aluminum hot-dipping layer affects the reaction between Al and Fe, which takes place during heating before hot stamping. From the viewpoint of moderately suppressing the above-mentioned reaction to secure press formability of the plating layer itself, the content of Si in the bath is preferably 1% or more, further preferably 3% or more. On the other hand, from the viewpoint of moderately accelerating the above-mentioned reaction to suppress deposition of Al on a press die, the content of Si in the bath is preferably 15% or less, further preferably 12% or less.

When hot-dipping is hot-dip galvanizing, the steel sheet is immersed in a hot-dip galvanizing bath, and then cooled to room temperature, and when hot-dipping is alloying hot-dip galvanizing, the steel sheet is immersed in a hot-dip galvanizing bath, then heated at a temperature of 600° C. or lower and thereby subjected to alloying treatment, and then cooled to room temperature. Al may be contained in a concentration of 0.01 to 3% in the hot-dip galvanizing bath. Al affects the reaction between Zn and Fe. When hot-dipping is hot-dip galvanizing, mutual diffusion of Zn and Fe can be suppressed by the reaction layer of Fe and Al. When hot-dipping is hot-dip galvanizing, it can be utilized for performing control to a suitable plating composition from the viewpoint of processability and plating adhesion. These effects from Al are exhibited by ensuring that the concentration of Al in the hot-dip galvanizing bath is 0.01 to 3%. Therefore, the concentration of Al in the hot-dip galvanizing bath may be selected according to a capacity of equipment involved in production, and a purpose.

(5) Method for Production of Present Invention Steel Material

The present invention steel material can be obtained by subjecting the present invention steel sheet using a usual method.

Embodiments of the present invention described above are merely illustrative, and various changes may be made in claims.

EXAMPLES

As tests common in examples below, details of a hydrogen embrittlement accelerating test and measurement of a critical diffusible hydrogen amount for evaluating hydrogen embrittlement resistance and details of a Charpy impact test for evaluating toughness will be first described.

Diffusible hydrogen was introduced into a test piece (steel sheet) by a cathode charge method in an electrolytic solution. That is, the test piece was used as a cathode and platinum electrode arranged around the test piece was used as an anode, a predetermined current density was passed between both the former and the latter to generate hydrogen on a surface of the test piece, and hydrogen was encouraged to diffuse to the inside of the test piece. An aqueous solution formed by dissolving $NH_4SCN$ and NaCl in pure water in concentrations of 0.3% and 3%, respectively, was used as an electrolytic solution.

Tension corresponding to residual stress as another factor to cause hydrogen embrittlement was applied by a "lever type" constant load tester using a weight (hereinafter, referred to as a "constant load test"; test piece is referred to as a "constant load test piece"). The constant load test piece was notched. A time until the test piece was ruptured was recorded, and the test piece was quickly collected after being ruptured. The electrolytic solution was removed, and a diffusible hydrogen amount was immediately measured by a temperature rising hydrogen analysis method using a gas chromatograph. A cumulative emission amount from room temperature to 250° C. was defined as a diffusible hydrogen amount.

By changing the current density while fixing the applied tension, a relationship between a diffusible hydrogen amount and a time until rupture as shown in FIG. 1 is determined. Here, "○" with an arrow indicates that the test piece had not ruptured even after elapse of a preset time. A period of 96 hours was employed as a set time. A median between a minimum value $H_{min}$ of the diffusible hydrogen amount of a ruptured test piece ("●" in FIG. 1) and a maximum value $H_{max}$ of the diffusible hydrogen amount of an unruptured test piece was defined as a critical diffusible hydrogen amount Hc. That is, Hc=(Hmin+Hmax)/2. Patent Literature 3 (JP2006-29977A) discloses a similar test method.

Hydrogen embrittlement resistance of a steel sheet with the plating on the surface was evaluated based on presence/absence of cracking by observing hole walls in a piercing test conducted with the clearance being changed. That is, a steel sheet having a sheet thickness of t (mm) was pierced with holes of 10 mmφ. At this time, the diameter Dp of a punch was fixed to 10 mm, and the inner diameter Di of a die was changed, so that the clearance=(Di−Dp)/2t×100 ranged from 5% to 30%. Presence/absence of cracking in hole walls was examined, and a steel sheet free from cracking was judged as a steel sheet excellent in hydrogen embrittlement resistance. The number of piercing was 5 or more per clearance, and all the hole walls were examined.

Toughness was evaluated by a Charpy impact test conforming to JIS Z 2242 irrespective of presence/absence of plating. The test piece was shaped in conformity with the No. 4 test piece in JIS Z 2202, and the thickness of the test piece was determined according to a steel sheet to be evaluated. The test was conducted in a range of −120° C. to 20° C. to determine a ductility brittleness transition temperature.

Example 1

A steel piece having the chemical composition shown in Table 1 was casted. The steel piece was heated to 1250° C. and hot-rolled to form a 2.8 mm-thick hot-rolled steel sheet at a finishing temperature of 870 to 920° C. The coiling temperature was set to 700° C. The steel sheet was pickled, and then cold-rolled at a draft of 50% to obtain a cold-rolled steel sheet having a sheet thickness of 1.4 mm. The cold-rolled steel sheet was subjected to recrystallization annealing such that the steel sheet was held at a temperature ranging from 700° C. to 800° C. for 1 minute and air-cooled to room temperature, thereby obtaining a sample material (steel sheet for hot stamping).

A test piece of 50×50 mm was taken from each sample material, and electrolyzed at a constant current in an electrolytic solution with acetylacetone and tetramethylammonium dissolved in methanol. The current value was set to 500 mA, and the electrolysis time was set to 4 hours. A filter having a pore diameter of 0.2 μm was used to collect residues, and the mass of the residues was divided by an electrolysis amount, and described in terms of a percentage. In this way, the concentration of a Mn-containing inclusion was determined.

The cross section of the sample material was observed with a SEM, and analyses of the inclusion, i.e. counting, dimension measurement and examination of constituent elements by EDS were performed. In this way, a number ratio of a Mn oxide to the inclusion having a maximum length of 1.0 to 4.0 μm was determined.

Figure 2:
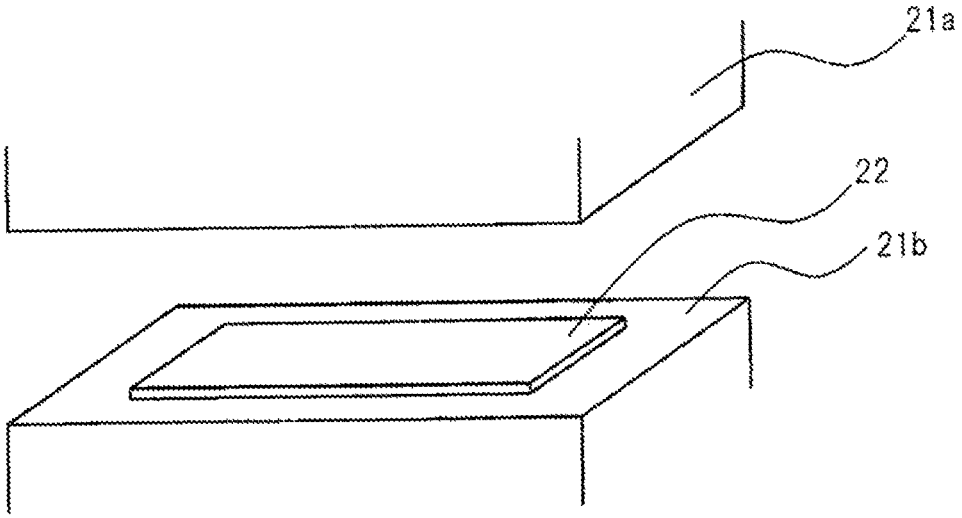
FIG. 2 is a view showing a hot stamping method and a die used in examples.
Figure 3:
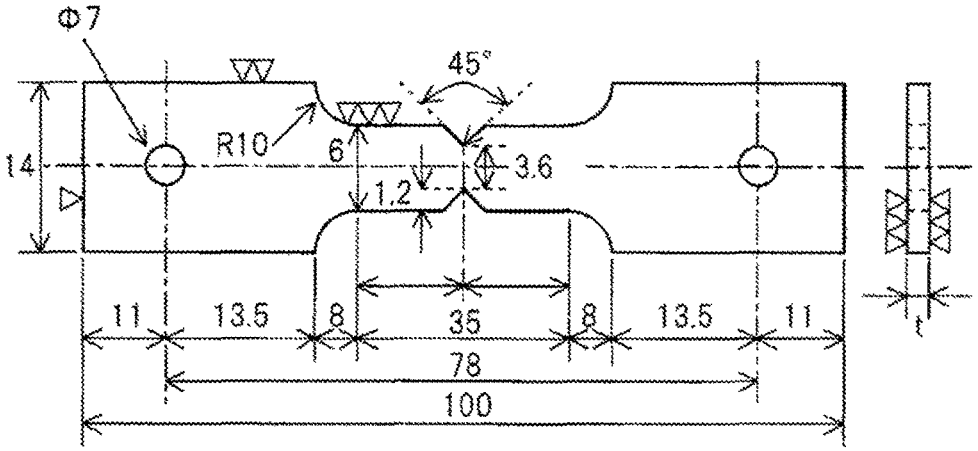
FIG. 3 is a view showing an aspect of a constant load test piece used in examples.

Each sample material was held in the air at 900° C. for 3 minutes, and then sandwiched between experimental flat press dies shown in FIG. 2, so that hot stamping was performed. That is, as shown in FIG. 2, a steel sheet 22 was processed by an upper die 21*a* and a lower die 21*b*. An average cooling rate to 200° C. as measured by providing a thermocouple was about 70° C./s. A JIS No. 5 tensile test piece, a constant load test piece shown in FIG. 3 and a Charpy impact test piece were taken from the steel material after hot stamping.

The constant load test was conducted by applying a tension corresponding to 90% of a tensile strength determined in the tensile test. The current density was set to 0.01 to 1 mA/cm$^2$.

Diffusible hydrogen was measured at a heating rate of 100° C./hour.

The Charpy impact test was conducted at a test temperature of 20° C., 0° C., −20° C., −40° C., −60° C., −80° C., −100° C. and −120° C., and a ductility brittleness transition temperature was determined from a change in absorbed energy.

For the test piece taking direction, the tensile direction was made perpendicular to the rolling direction of the steel sheet in the case of the tensile test piece and the constant load test piece, and the longitudinal direction was made parallel to the rolling direction in the case of the Charpy test piece. The sheet thickness of the tensile test piece was set to 1.4 mm, and the sheet thickness of other test pieces was set to 1.2 mm by grinding both surfaces. The results are shown in Table 2.

TABLE 1

| STEEL | C | Si | Mn | P | S | Al | N | 0 | OTHERS | REMARKS |
|---|---|---|---|---|---|---|---|---|---|---|
| | CHEMICAL COMPOSITION (UNIT: % BY MASS, BALANCE: Fe AND IMPURITIES) | | | | | | | | | |
| a | 0.18 | 0.015 | 1.5 | 0.02 | 0.004 | 0.001 | 0.004 | 0.007 | — | COMPARATIVE STEEL |
| b | 0.18 | 0.025 | 1.5 | 0.02 | 0.004 | 0.001 | 0.004 | 0.007 | Cr: 0.2, Ti: 0.001, B: 0.0035 | RELEVENT STEEL |
| c | 0.18 | 0.045 | 1.5 | 0.02 | 0.004 | 0.003 | 0.004 | 0.007 | Nb: 0.01, B: 0.0035 | RELEVENT STEEL |
| d | 0.18 | 0.055 | 1.5 | 0.02 | 0.004 | 0.003 | 0.004 | 0.007 | Cr: 0.2, Ti: 0.005, B: 0.0025 | COMPARATIVE STEEL |
| e | 0.22 | 0.015 | 1.2 | 0.02 | 0.004 | 0.001 | 0.003 | 0.0006 | Cr: 0.01, B: 0.0025 | COMPARATIVE STEEL |
| f | 0.22 | 0.025 | 1.2 | 0.02 | 0.002 | 0.005 | 0.003 | 0.005 | — | RELEVENT STEEL |
| g | 0.22 | 0.025 | 1.2 | 0.02 | 0.002 | 0.003 | 0.003 | 0.009 | B: 0.0025 | RELEVENT STEEL |
| h | 0.22 | 0.025 | 1.2 | 0.02 | 0.002 | 0.003 | 0.003 | 0.012 | Ti: 0.01, B: 0.005 | RELEVENT STEEL |
| i | 0.24 | 0.025 | 1.0 | 0.01 | 0.002 | 0.005 | 0.003 | 0.007 | Cr: 0.2 | RELEVENT STEEL |
| j | 0.24 | 0.030 | 1.0 | 0.01 | 0.002 | 0.005 | 0.003 | 0.007 | Ti: 0.01, B: 0.003 | RELEVENT STEEL |
| k | 0.24 | 0.035 | 1.0 | 0.01 | 0.002 | 0.005 | 0.003 | 0.021 | Ti: 0.01 | COMPARATIVE STEEL |
| l | 0.24 | 0.030 | 0.9 | 0.01 | 0.002 | 0.005 | 0.003 | 0.003 | Nb: 0.1 | COMPARATIVE STEEL |
| m | 0.26 | 0.010 | 1.5 | 0.02 | 0.004 | 0.6 | 0.003 | 0.010 | Nb: 0.03 | COMPARATIVE STEEL |
| n | 0.26 | 0.025 | 1.0 | 0.02 | 0.002 | 0.001 | 0.002 | 0.007 | Cr: 0.2, B: 0.0030 | RELEVENT STEEL |
| o | 0.26 | 0.035 | 1.0 | 0.02 | 0.002 | 0.003 | 0.003 | 0.015 | — | RELEVENT STEEL |
| p | 0.26 | 0.030 | 1.0 | 0.02 | 0.004 | 0.003 | 0.004 | 0.010 | Cr: 1.0, Ti: 0.03, B: 0.005 | RELEVENT STEEL |

UNDERLINES IN THE TABLE INDICATE THE VALUES FALL OUT OF THE RANGE SPECIFIED IN THE PRESENT INVENTION

TABLE 2

| No. | STEEL | CONCENTRATION OF Mn-CONTAINING INCLUSION (% BY MASS) | Mn-CONTAINING INCLUSION HAVING MAXIMUM LENGTH OF 1.0 TO 4.0 μm: NUMBER OF OBSERVED INCLUSIONS (NUMBER) | NUMBER OF Mn OXIDES (NUMBER) | NUMBER RATIO OF NUMBER OF Mn OXIDES (%) | TENSILE STRENGTH (MPa) | Hc (ppm) | DUCTILITY BRITTLENESS TRANSITION TEMPERATURE (° C.) | REMARKS |
|---|---|---|---|---|---|---|---|---|---|
| 1 | a | 0.26 | 501 | 261 | 52.1 | 1502 | 0.74 | −35 | COMPARATIVE EXAMPLE |
| 2 | b | 0.15 | 500 | 69 | 13.8 | 1510 | 0.96 | −69 | PRESENT INVENTION EXAMPLE |
| 3 | c | 0.12 | 512 | 52 | 10.2 | 1512 | 0.90 | −70 | PRESENT INVENTION EXAMPLE |
| 4 | d | 0.10 | 508 | 49 | 9.6 | 1514 | 0.45 | −55 | COMPARATIVE EXAMPLE |
| 5 | e | 0.13 | 501 | 21 | 4.2 | 1542 | 0.30 | 70 | COMPARATIVE EXAMPLE |
| 6 | f | 0.16 | 504 | 136 | 27.0 | 1545 | 0.92 | −68 | PRESENT INVENTION EXAMPLE |
| 7 | g | 0.14 | 502 | 172 | 34.3 | 1540 | 0.91 | −66 | PRESENT INVENTION EXAMPLE |
| 8 | h | 0.18 | 500 | 181 | 36.2 | 1546 | 0.94 | −67 | PRESENT INVENTION EXAMPLE |
| 9 | i | 0.15 | 500 | 124 | 24.8 | 1577 | 0.90 | −71 | PRESENT INVENTION EXAMPLE |

TABLE 2-continued

| No. | STEEL | CONCENTRATION OF Mn-CONTAINING INCLUSION (% BY MASS) | Mn-CONTAINING INCLUSION HAVING MAXIMUM LENGTH OF 1.0 TO 4.0 μm: NUMBER OF OBSERVED INCLUSIONS (NUMBER) | NUMBER OF Mn OXIDES (NUMBER) | NUMBER RATIO OF NUMBER OF Mn OXIDES (%) | TENSILE STRENGTH (MPa) | Hc (ppm) | DUCTILITY BRITTLENESS TRANSITION TEMPERATURE (° C.) | REMARKS |
|---|---|---|---|---|---|---|---|---|---|
| 10 | j | 0.13 | 503 | 139 | 27.6 | 1570 | 0.92 | −68 | PRESENT INVENTION EXAMPLE |
| 11 | k | 0.32 | 502 | 208 | 41.5 | 1562 | 0.72 | −29 | COMPARATIVE EXAMPLE |
| 12 | l | 0.11 | 500 | 45 | 9.0 | 1566 | 0.32 | −65 | COMPARATIVE EXAMPLE |
| 13 | m | 0.02 | 500 | 7 | 1.4 | 1582 | 0.22 | −31 | COMPARATIVE EXAMPLE |
| 14 | n | 0.18 | 500 | 121 | 24.2 | 1590 | 0.89 | −61 | PRESENT INVENTION EXAMPLE |
| 15 | o | 0.22 | 500 | 154 | 30.8 | 1596 | 0.90 | −60 | PRESENT INVENTION EXAMPLE |
| 16 | p | 0.17 | 507 | 115 | 22.7 | 1598 | 0.84 | −62 | PRESENT INVENTION EXAMPLE |

UNDERLINES IN THE TABLE INDICATE THE VALUES FALL OUT OF THE RANGE SPECIFIED IN THE PRESENT INVENTION

In every example, the steel sheet after hot stamping showed a tensile strength of 1500 MPa or more. Samples Nos. 2, 3, 6 to 10 and 14 to 16 in which both the concentration of the Mn-containing inclusion and the number ratio of the Mn oxide to the inclusion having a maximum length of 1.0 to 4.0 μm fell within the range specified in the present invention had good hydrogen embrittlement resistance and toughness with the critical diffusible hydrogen amount He of 0.84 ppm or more and the ductility brittleness transition temperature of −60° C. or lower.

On the other hand, samples Nos. 1 and 11 in which the concentration of the Mn-containing inclusion fell out of the range specified in the present invention were poor in toughness with the ductility brittleness transition temperature being much higher as compared to present invention examples having a comparable tensile strength. Samples Nos. 4, 5, 12 and 13 in which the number ratio of the Mn oxide to the inclusion having a maximum length of 1.0 to 4.0 μm fell out of the range specified in the present invention were poor in hydrogen embrittlement resistance with the He being significantly smaller as compared to present invention examples. The sample No. 13 has a much higher ductility brittleness transition temperature as compared to present invention examples having a comparable tensile strength although the concentration of the Mn-containing inclusion falls within the range specified in the present invention. It is thought that because of the fact that the Al content is high (falls out of the range specified in the present invention), an Al-based oxide is contained in a high concentration.

Example 2

Figure 4:
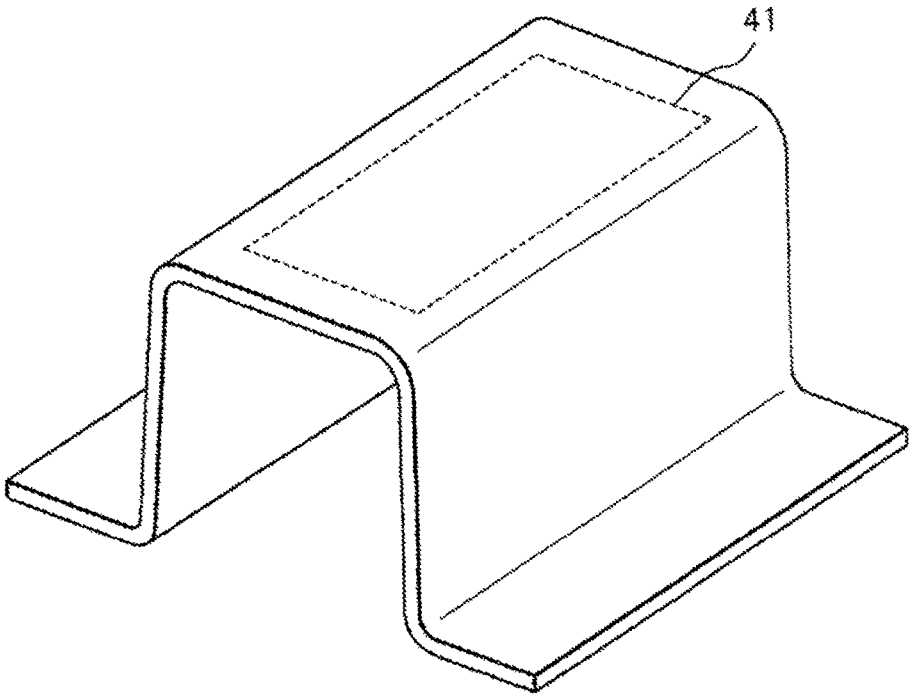
FIG. 4 is a view showing an aspect of a steel sheet (member) pressed into a hat shape.

A steel piece having the chemical composition shown in Table 3 was casted. The steel piece was heated to 1250° C. and hot-rolled to form a 3.0 mm-thick hot-rolled steel sheet at a finishing temperature of 880 to 920° C. The coiling temperature was set to 700° C. The steel sheet was pickled, and then cold-rolled at a draft of 50% to obtain a cold-rolled steel sheet having a sheet thickness of 1.5 mm. The cold-rolled steel sheet was subjected to recrystallization annealing such that the steel sheet was held at a temperature ranging from 700° C. to 800° C. for 1 minute and air-cooled to room temperature, thereby obtaining a sample material (steel sheet for hot stamping). A concentration of a Mn-containing inclusion and a number ratio of a Mn oxide to the inclusion having a maximum length of 1.0 to 4.0 μm were determined in the same manner as in Example 1. Further, a sample material was held in the air at 900° C. for 5 minutes, and then pressed into a hat shape shown in FIG. 4 using a hot stamping method. An average cooling rate to 200° C. as measured by providing a thermocouple was about 35° C./s. From a test piece taking position 41 (hat head portion) shown in FIG. 4, a JIS No. 5 tensile test piece, a constant load test piece and a Charpy impact test piece were taken. The relationship between the test piece taking direction and the steel sheet rolling direction was same as that in Example 1. The sheet thickness of the tensile test piece was set to 1.5 mm, and the sheet thickness of other test pieces was set to 1.3 mm by grinding both surfaces. The constant load test was conducted by applying a tension corresponding to 90% of a tensile strength determined in the tensile test. The current density was set to 0.01 to 1 mA/cm$^2$. Diffusible hydrogen was measured at a heating rate of 100° C./hour. The Charpy impact test was conducted at a test temperature of 20° C., 0° C., −20° C., −40° C., −60° C., −80° C., −100° C. and −120° C., and a ductility brittleness transition temperature was determined from a change in absorbed energy. The results are shown in Table 4.

TABLE 3

| STEEL | C | Si | Mn | P | S | Al | N | 0 | OTHERS | REMARKS |
|---|---|---|---|---|---|---|---|---|---|---|
| | CHEMICAL COMPOSITION (UNIT: % BY MASS, BALANCE: Fe AND IMPURITIES) | | | | | | | | | |
| 2a | 0.22 | 0.015 | 1.2 | 0.02 | 0.002 | 0.005 | 0.003 | 0.005 | V: 0.5 | COMPARATIVE STEEL |
| 2b | 0.22 | 0.025 | 1.2 | 0.02 | 0.002 | 0.005 | 0.003 | 0.005 | V: 0.5 | RELEVENT STEEL |
| 2c | 0.22 | 0.025 | 1.2 | 0.02 | 0.002 | 0.005 | 0.003 | 0.005 | Mo: 0.2 | RELEVENT STEEL |
| 2d | 0.22 | 0.025 | 1.2 | 0.02 | 0.002 | 0.005 | 0.003 | 0.005 | W: 0.2 | RELEVENT STEEL |
| 2e | 0.22 | 0.025 | 1.2 | 0.02 | 0.002 | 0.005 | 0.003 | 0.005 | W: 0.5 | RELEVENT STEEL |
| 2f | 0.22 | 0.025 | 1.2 | 0.02 | 0.002 | 0.005 | 0.003 | 0.005 | Cu: 0.5, Ni: 0.3 | RELEVENT STEEL |
| 2g | 0.22 | 0.025 | 1.2 | 0.02 | 0.002 | 0.005 | 0.003 | 0.005 | Mo: 0.1, W: 0.2, V: 0.2 | RELEVENT STEEL |
| 2h | 0.22 | 0.025 | 1.2 | 0.02 | 0.002 | 0.005 | 0.003 | 0.005 | B: 0.002, Mo: 0.1, V: 0.2 | RELEVENT STEEL |
| 2i | 0.22 | 0.030 | 1.6 | 0.02 | 0.007 | 0.001 | 0.003 | 0.025 | B: 0.002, Nb: 0.5 | COMPARATIVE STEEL |
| 2j | 0.22 | 0.055 | 0.6 | 0.01 | 0.002 | 0.003 | 0.003 | 0.007 | R: 0.002, Cu: 1.0, Ni: 0.5 | COMPARATIVE STEEL |
| 2k | 0.22 | 0.025 | 1.2 | 0.02 | 0.002 | 0.005 | 0.003 | 0.005 | B: 0.003, Mo: 1.0 | RELEVENT STEEL |
| 2l | 0.22 | 0.025 | 1.2 | 0.02 | 0.002 | 0.005 | 0.003 | 0.005 | Nb: 0.2, V: 0.5 | RELEVENT STEEL |
| 2m | 0.22 | 0.060 | 1.2 | 0.02 | 0.002 | 0.003 | 0.003 | 0.005 | B: 0.002, V: 0.5 | COMPARATIVE STEEL |
| 2n | 0.22 | 0.025 | 1.2 | 0.02 | 0.002 | 0.002 | 0.003 | 0.0007 | B: 0.004 , Cu: 0.5, Ni: 0.5 | COMPARATIVE STEEL |
| 2o | 0.22 | 0.025 | 1.2 | 0.02 | 0.002 | 0.005 | 0.003 | 0.005 | B: 0.002, Nb: 0.2, W: 0.2, V: 0.3 | RELEVENT STEEL |
| 2p | 0.22 | 0.025 | 0.6 | 0.01 | 0.002 | 0.001 | 0.003 | 0.007 | B: 0.003, Mo: 0.2, V: 0.3 | COMPARATIVE STEEL |

UNDERLINES IN THE TABLE INDICATE THE VALUES FALL OUT OF THE RANGE SPECIFIED IN THE PRESENT INVENTION

TABLE 4

| No. | STEEL | CONCENTRATION OF Mn-CONTAINING INCLUSION (% BY MASS) | Mn-CONTAINING INCLUSION HAVING MAXIMUM LENGTH OF 1.0 TO 4.0 μm: NUMBER OF OBSERVED INCLUSIONS (NUMBER) | NUMBER OF Mn OXIDES (NUMBER) | NUMBER RATIO OF NUMBER OF Mn OXIDES (%) | TENSILE STRENGTH (MPa) | Hc (ppm) | DUCTILITY BRITTLENESS TRANSITION TEMPERATURE (° C.) | REMARKS |
|---|---|---|---|---|---|---|---|---|---|
| 17 | 2a | 0.27 | 501 | 113 | 22.6 | 1580 | 0.60 | −48 | COMPARATIVE EXAMPLE |
| 18 | 2b | 0.15 | 500 | 125 | 25.0 | 1585 | 0.98 | −68 | PRESENT INVENTION EXAMPLE |
| 19 | 2c | 0.14 | 512 | 109 | 21.3 | 1588 | 0.96 | −67 | PRESENT INVENTION EXAMPLE |
| 20 | 2d | 0.19 | 508 | 126 | 24.8 | 1592 | 0.96 | −68 | PRESENT INVENTION EXAMPLE |
| 21 | 2e | 0.16 | 504 | 119 | 23.6 | 1590 | 0.96 | −69 | PRESENT INVENTION EXAMPLE |
| 22 | 2f | 0.12 | 500 | 110 | 22.0 | 1586 | 0.91 | −65 | PRESENT INVENTION EXAMPLE |
| 23 | 2g | 0.10 | 500 | 118 | 23.6 | 1587 | 1.02 | −67 | PRESENT INVENTION EXAMPLE |
| 24 | 2h | 0.13 | 502 | 109 | 21.7 | 1591 | 1.00 | −68 | PRESENT INVENTION EXAMPLE |
| 25 | 2i | 0.39 | 511 | 302 | 59.1 | 1600 | 0.56 | −36 | COMPARATIVE EXAMPLE |

TABLE 4-continued

| No. | STEEL | CONCENTRATION OF Mn-CONTAINING INCLUSION (% BY MASS) | Mn-CONTAINING INCLUSION HAVING MAXIMUM LENGTH OF 1.0 TO 4.0 μm: NUMBER OF OBSERVED INCLUSIONS (NUMBER) | NUMBER OF Mn OXIDES (NUMBER) | NUMBER RATIO OF NUMBER OF Mn OXIDES (%) | TENSILE STRENGTH (MPa) | Hc (ppm) | DUCTILITY BRITTLENESS TRANSITION TEMPERATURE (° C.) | REMARKS |
|---|---|---|---|---|---|---|---|---|---|
| 26 | 2j | 0.005 | 500 | 40 | 7.9 | 1602 | 0.55 | −65 | COMPARATIVE EXAMPLE |
| 27 | 2k | 0.15 | 500 | 134 | 26.8 | 1588 | 0.95 | −65 | PRESENT INVENTION EXAMPLE |
| 28 | 2l | 0.12 | 503 | 123 | 24.5 | 1589 | 1.04 | −70 | PRESENT INVENTION EXAMPLE |
| 29 | 2m | 0.007 | 504 | 49 | 9.8 | 1594 | 0.60 | −65 | COMPARATIVE EXAMPLE |
| 30 | 2n | 0.18 | 500 | 103 | 4.3 | 1590 | 0.35 | −68 | COMPARATIVE EXAMPLE |
| 31 | 2o | 0.16 | 512 | 151 | 29.4 | 1587 | 1.05 | −71 | PRESENT INVENTION EXAMPLE |
| 32 | 2p | 0.02 | 502 | 47 | 9.4 | 1584 | 0.61 | −69 | COMPARATIVE EXAMPLE |

UNDERLINES IN THE TABLE INDICATE THE VALUES FALL OUT OF THE RANGE SPECIFIED IN THE PRESENT INVENTION

In every example, the steel sheet after hot stamping showed a tensile strength of 1580 MPa or more. Among them, samples Nos. 18 to 24, 27, 28 and 31 in which both the concentration of the Mn-containing inclusion and the number ratio of the Mn oxide to the inclusion having a maximum length of 1.0 to 4.0 μm fell within the range specified in the present invention had good hydrogen embrittlement resistance and toughness with the He of 0.91 ppm or more and the ductility brittleness transition temperature of −65° C. or lower.

On the other hand, samples Nos. 17 and 25 in which the concentration of the Mn-containing inclusion exceeded the range specified in the present invention were poor in toughness and had ductility brittleness transition temperatures much higher as compared to present invention examples. Samples Nos. 26, 29, 30 and 32 in which the number ratio of the Mn oxide to the inclusion having a maximum length of 1.0 to 4.0 μm fell out of the range specified in the present invention is apparently poor in hydrogen embrittlement resistance and had the He smaller as compared to present invention examples. The sample No. 25 has a small He although the number of Mn oxides falls within the range specified in the present invention. This is thought that because of the fact that the Mn content and the O content are high (fall out of the range specified in the present invention), the distribution of the size of the Mn oxide is biased to the side of the larger size as compared present invention examples, and therefore the number of gaps between the Mn oxide and the steel is small.

Example 3

A steel piece having the chemical composition shown in Table 5 was casted. The steel piece was heated to 1200° C. and hot-rolled to form a 2.0 to 4.0 mm-thick hot-rolled steel sheet at a finishing temperature of 880 to 920° C. The steel sheet was coiled at a plurality of coiling temperatures while conditions for cooling on a cooling bed (ROT) were controlled. The steel sheet was pickled, and then cold-rolled at a draft of 50% to obtain a cold-rolled steel sheet. The cold-rolled steel sheet was subjected to recrystallization annealing such that the steel sheet was held at 700° C. to 800° C. for 1 minute and air-cooled to room temperature, thereby obtaining a sample material (steel sheet for hot stamping). A concentration of a Mn-containing inclusion and a number ratio of a Mn oxide to the Mn-containing inclusion having a maximum length of 1.0 to 4.0 μm were determined in the same manner as in Example 1. Hot stamping was performed using a flat die identical to that in Example 1. A tensile test piece, a constant load test piece and a Charpy impact test piece were taken from the steel sheet after hot stamping in the same manner as in Example 1. For the sheet thickness of the test piece, the tensile test piece had a sheet thickness identical to that of the cold-rolled steel sheet, and other test pieces had a sheet thickness obtained by grinding both surfaces of the cold-rolled steel sheet to a depth of 0.1 mm. A constant load test, measurement of diffusible hydrogen and a Charpy impact test were also performed in the same manner as in Example 1. The finishing sheet thickness of the hot-rolled sheet, the coiling temperature, the results of examining the inclusion, hydrogen embrittlement resistance (Hc) and toughness are collectively shown in Table 6.

TABLE 5

| STEEL | CHEMICAL COMPOSITION (UNIT: % BY MASS, BALANCE: Fe AND IMPURITIES) C | Si | Mn | P | S | Al | N | 0 | OTHERS |
|---|---|---|---|---|---|---|---|---|---|
| 3a | 0.20 | 0.025 | 1.0 | 0.02 | 0.004 | 0.003 | 0.003 | 0.05 | B: 0.004 |
| 3b | 0.26 | 0.025 | 1.5 | 0.02 | 0.004 | 0.003 | 0.003 | 0.007 | Cr: 1.0, Mo: 0.2, W: 0.2, V:0.5 |

TABLE 6

| No. | STEEL | HOT-ROLLED SHEET THICK-NESS | COOL-ING TEMPER-ATURE (° C.) | CONCEN-TRATION OF Mn-CONTAIN-ING INCLU-SION (% BY MASS) | Mn-CONTAINING INCLUSION HAVING MAXIMUM LENGTH OF 1.0 TO 4.0 μm: NUMBER OF OBSERVED INCLU-SIONS (NUMBER) | NUMBER OF Mn OXIDES (NUMBER) | NUMBER RATIO OF NUMBER OF Mn OXIDES (%) | TENSILE STRENGTH (MPa) | Hc (ppm) | DUCTIL-ITY BRITTLE-NESS TRAN-SITION TEMPER-ATURE (° C.) | REMARKS |
|---|---|---|---|---|---|---|---|---|---|---|---|
| 33 | 3a | 2.8 | 700 | 0.15 | 500 | 89 | 17.8 | 1508 | 0.90 | −66 | PRESENT INVENTION EXAMPLE |
| 34 | 3a | 2.8 | 690 | 0.16 | 500 | 73 | 14.6 | 1516 | 0.89 | −67 | PRESENT INVENTION EXAMPLE |
| 35 | 3a | 2.8 | 680 | 0.14 | 504 | 47 | 9.4 | 1520 | 0.48 | −47 | COMPARATIVE EXAMPLE |
| 36 | 3a | 3.2 | 710 | 0.14 | 500 | 78 | 15.6 | 1503 | 0.92 | −68 | PRESENT INVENTION EXAMPLE |
| 37 | 3a | 3.2 | 700 | 0.16 | 501 | 67 | 13.4 | 1510 | 0.90 | −65 | PRESENT INVENTION EXAMPLE |
| 38 | 3a | 3.2 | 680 | 0.13 | 500 | 45 | 9.0 | 1518 | 0.44 | −45 | COMPARATIVE EXAMPLE |
| 39 | 3a | 4.0 | 720 | 0.17 | 507 | 77 | 15.2 | 1500 | 0.88 | −69 | PRESENT INVENTION EXAMPLE |
| 40 | 3a | 4.0 | 690 | 0.15 | 500 | 57 | 11.4 | 1506 | 0.91 | −70 | PRESENT INVENTION EXAMPLE |
| 41 | 3a | 4.0 | 660 | 0.15 | 502 | 46 | 9.1 | 1514 | 0.46 | −44 | COMPARATIVE EXAMPLE |
| 42 | 3b | 2.0 | 710 | 0.19 | 500 | 85 | 17 | 1596 | 1.06 | −60 | PRESENT INVENTION EXAMPLE |
| 43 | 3b | 2.0 | 690 | 0.20 | 508 | 81 | 15.9 | 1600 | 1.03 | −59 | PRESENT INVENTION EXAMPLE |
| 44 | 3b | 2.0 | 670 | 0.18 | 500 | 45 | 8.9 | 1606 | 0.68 | −40 | COMPARATIVE EXAMPLE |
| 45 | 3b | 2.4 | 750 | 0.20 | 503 | 58 | 11.5 | 1587 | 1.01 | −61 | PRESENT INVENTION EXAMPLE |
| 46 | 3b | 2.4 | 700 | 0.21 | 500 | 52 | 10.3 | 1613 | 0.98 | −63 | PRESENT INVENTION EXAMPLE |
| 47 | 3b | 2.4 | 645 | 0.18 | 500 | 48 | 9.5 | 1622 | 0.70 | −43 | COMPARATIVE EXAMPLE |
| 48 | 3b | 3.2 | 740 | 0.19 | 500 | 82 | 16.3 | 1594 | 1.07 | −59 | PRESENT INVENTION EXAMPLE |
| 49 | 3b | 3.2 | 710 | 0.22 | 500 | 70 | 13.9 | 1601 | 1.02 | −58 | PRESENT INVENTION EXAMPLE |
| 50 | 3b | 3.2 | 680 | 0.21 | 500 | 49 | 9.8 | 1618 | 0.69 | −41 | COMPARATIVE EXAMPLE |

UNDERLINES IN THE TABLE INDICATE THE VALUES FALL OUT OF THE RANGE SPECIFIED IN THE PRESENT INVENTION

The tensile strength of the steel sheet after hot stamping was independent of the finishing sheet thickness, and the steel 3*a* showed a tensile strength of 1500 to 1520 MPa and the steel 3*b* showed a tensile strength of 1587 to 1622 MPa. When comparing samples having the same sheet thickness, it is shown that the tensile strength tends to increase as the coiling temperature decreases, and therefore it is thought that the strength of the sample material is affected by the coiling temperature. The concentration of the Mn-containing inclusion fell within the range specified in the present invention in every example, but in samples Nos. 35, 38, 41, 44, 47 and 50 of comparative examples in which the coiling temperature fell out of the range specified in the present invention, the number ratio of the Mn oxide to the Mn-containing inclusion having a maximum length of 1.0 to 4.0 μm fell out of the range specified in the present invention (less than 10%), and accordingly the Hc was significantly smaller compared to two present invention examples with the same finishing thickness of the same steel, leading to poor hydrogen embrittlement resistance, and also the ductility brittleness transition temperature was higher compared to two present invention examples with the same finishing thickness of the same steel, leading to poor toughness. In view of the fact that in all of these comparative examples, the concentration of the Mn-containing inclusion fell within the range specified in the present invention, it is thought that in these comparative examples, crushing of the Mn oxide was insufficient, so that gaps capable of serving as a trap site for diffusible hydrogen could not be sufficiently secured, and therefore the value of He became small, and the ductility brittleness transition temperature was increased because an inclusion stretched without being crushed remained. Samples Nos. 33, 34, 36, 37, 39, 40, 42, 43, 45, 46, 48 and 49 of present invention examples in which the coiling temperature fell within the range specified in the present invention were excellent in both hydrogen embrittlement resistance and toughness.

Example 4

A steel piece having the chemical composition shown in Table 7 was produced. The steel piece was formed into a 2.8 mm-thick hot-rolled steel sheet under the conditions same as those in Example 1, and the steel sheet was pickled, and then cold-rolled (draft: 50%) into a steel sheet having a sheet thickness of 1.4 mm. The cold-rolled steel sheet was heated to 655° C. at an average heating rate of 19° C./s, subsequently heated to 730 to 780° C. at an average heating rate of 2.5° C./s, immediately cooled at an average cooling rate of 6.5° C./s, immersed in an aluminum-plating bath (containing Si in a concentration of 10% and impurities) at 670° C., and taken out after 5 seconds. The deposition amount was adjusted with a gas wiper, followed by air-cooling the steel sheet to room temperature. Analysis of the inclusion of the obtained steel sheet was performed in the same manner as in Example 1. In the same manner as in Example 2, the steel sheet was hot-stamped into a hat shape, and a JIS No. 5 tensile test piece, a piercing testing test piece and a Charpy impact test piece were taken from the hat portion. For heating conditions for hot stamping, the steel sheet was held at 900° C. for 1 minute, nitrogen containing hydrogen in a concentration of 3% was set as an atmosphere, and the dew point was set to 0° C. Analysis results related to the inclusion are shown in Table 8, and test results related to the hot stamp material are collectively shown in Table 9.

TABLE 7

| | CHEMICAL COMPOSITION (UNIT: % BY MASS, BALANCE: Fe AND IMPURITIES) | | | | | | | | |
|---|---|---|---|---|---|---|---|---|---|
| STEEL | C | Si | Mn | P | S | Al | N | 0 | OTHERS |
| 4a | 0.20 | 0.025 | 1.5 | 0.2 | 0.004 | 0.003 | 0.025 | 0.007 | Cr: 1.0, B: 0.004 |
| 4b | 0.22 | 0.025 | 1.3 | 0.2 | 0.002 | 0.003 | 0.025 | 0.006 | B: 0.003, Mo: 0.2, W: 0.1, V:0.1 |
| 4c | 0.24 | 0.040 | 1.1 | 0.2 | 0.002 | 0.003 | 0.025 | 0.007 | Nb: 0.02 |

TABLE 8

| | | | | Mn-CONTAINING INCLUSION HAVING MAXIMUM LENGTH OF 1.0 TO 4.0 μm | | |
|---|---|---|---|---|---|---|
| No. | STEEL | THICKNESS OF Al PLATING LAYER (μm) | CONCENTRATION OF Mn-CONTAINING INCLUSION (% BY MASS) | NUMBER OF OBSERVED INCLUSIONS (NUMBER) | NUMBER OF Mn OXIDES (NUMBER) | NUMBER RATIO OF NUMBER OF Mn OXIDES (%) |
| 51 | 4a | 16.1 | 0.15 | 500 | 60 | 12.0 |
| 52 | 4a | 22.1 | 0.16 | 500 | 64 | 12.8 |
| 53 | 4a | 33.8 | 0.15 | 500 | 63 | 12.6 |
| 54 | 4a | 48.7 | 0.17 | 500 | 66 | 13.2 |
| 55 | 4a | 51.1 | 0.15 | 502 | 63 | 12.5 |
| 56 | 4b | 15.2 | 0.11 | 500 | 73 | 14.6 |
| 57 | 4b | 19.7 | 0.13 | 500 | 70 | 14.0 |
| 58 | 4b | 34.1 | 0.11 | 504 | 71 | 14.1 |
| 59 | 4b | 49.5 | 0.13 | 500 | 86 | 17.2 |
| 60 | 4b | 54.8 | 0.12 | 500 | 74 | 14.8 |
| 61 | 4c | 14.3 | 0.15 | 500 | 56 | 11.2 |
| 62 | 4c | 20.0 | 0.15 | 500 | 61 | 12.2 |
| 63 | 4c | 34.7 | 0.17 | 500 | 55 | 11.0 |
| 64 | 4c | 49.3 | 0.16 | 500 | 57 | 11.4 |
| 65 | 4c | 55.4 | 0.15 | 500 | 66 | 13.2 |

UNDERLINES IN THE TABLE INDICATE THE VALUES FALL OUT OF THE SUITABLE RANGE SPECIFIED IN THE PRESENT INVENTION

TABLE 9

| No. | STEEL | TENSILE STRENGTH (MPa) | NUMBER OF CRACKS IN HOLE WALL PORTION (NUMBER) | DUCTILITY BRITTLENESS TRANSITION TEMPERATURE (° C.) | HOT STAMPING STATE |
|---|---|---|---|---|---|
| 51 | 4a | 1510 | 0 | −62 | GOOD |
| 52 | 4a | 1512 | 0 | −69 | GOOD |
| 53 | 4a | 1519 | 6 | −67 | GOOD |

TABLE 9-continued

| No. | STEEL | TENSILE STRENGTH (MPa) | NUMBER OF CRACKS IN HOLE WALL PORTION (NUMBER) | DUCTILITY BRITTLENESS TRANSITION TEMPERATURE (° C.) | HOT STAMPING STATE |
|---|---|---|---|---|---|
| 54 | 4a | 1508 | 0 | −68 | GOOD |
| 55 | 4a | 1511 | 0 | −61 | GALLING |
| 56 | 4b | 1540 | 6 | −67 | GOOD |
| 57 | 4b | 1543 | 0 | −61 | GOOD |
| 58 | 4b | 1546 | 0 | −69 | GOOD |
| 59 | 4b | 1539 | 0 | −66 | GOOD |
| 60 | 4b | 1544 | 0 | −66 | GALLING |
| 61 | 4c | 1563 | 0 | −64 | GOOD |
| 62 | 4c | 1560 | 0 | −61 | GOOD |
| 63 | 4c | 1559 | 0 | −60 | GOOD |
| 64 | 4c | 1561 | 0 | −62 | GOOD |
| 65 | 4c | 1558 | 0 | −63 | GALLING |

In every example, the concentration of the Mn-containing inclusion and the number ratio of the Mn oxide to the Mn-containing inclusion having a maximum length of 1.0 to 4.0 μm fell within the range specified in the present invention, and therefore cracking did not occur in hole walls in the piercing test and the ductility brittleness transition temperature was −60° C. or lower, so that a steel sheet (member) having both hydrogen embrittlement resistance and toughness was obtained, but in samples Nos. 55, 60 and 65 in which the thickness of the Al-plating layer was more than 50 μm, galling occurred in the hat-shaped longitudinal wall portion with high frequency. On the other hand, in samples Nos. 51 to 54, 56 to 59 and 61 to 64 in which the thickness of the Al-plating layer was 50 μm or less, galling did not occur at all in the hat-shaped longitudinal wall portion.

Example 5

A steel piece having the chemical composition shown in Table 7 was formed into a 2.8 mm-thick hot-rolled steel sheet under the conditions same as those in Example 1, and the steel sheet was pickled, and then cold-rolled into a steel sheet having a sheet thickness of 1.2 mm. The cold-rolled steel sheet was heated to 655° C. at an average heating rate of 19° C./s, subsequently heated to 730 to 780° C. at an average heating rate of 2.5° C./s, immediately cooled at an average cooling rate of 6.5° C./s, immersed in a hot-dip galvanizing bath (containing Al in a concentration of 0.15% and impurities) at 460° C., and taken out after 3 seconds. The deposition amount was adjusted with a gas wiper, followed by air-cooling the steel sheet to room temperature. Analysis of the inclusion of the obtained steel sheet was performed in the same manner as in Example 1. In the same manner as in Example 2, the steel sheet was hot-stamped into a hat shape, and a JIS No. 5 tensile test piece, a piercing test piece and a Charpy impact test piece were taken from the hat portion. For heating conditions for hot stamping, the steel sheet was held at 900° C. for 1 minute, nitrogen containing hydrogen in a concentration of 3% was set as an atmosphere, and the dew point was set to 0° C. Analysis results related to the inclusion are shown in Table 10, and test results related to the hot stamp material are collectively shown in Table 11.

TABLE 10

| | | | | Mn-CONTAINING INCLUSION HAVING MAXIMUM LENGTH OF 1.0 TO 4.0 μm | | |
|---|---|---|---|---|---|---|
| No. | STEEL | THICKNESS OF GALVANIZED LAYER (μm) | CONCENTRATION OF Mn-CONTAINING INCLUSION (% BY MASS) | NUMBER OF OBSERVED INCLUSIONS (NUMBER) | NUMBEROF Mn OXIDES (NUMBER) | NUMBER RATIO OF NUMBER OF Mn OXIDES (%) |
| 66 | 4a | 6.3 | 0.15 | 500 | 66 | 13.2 |
| 67 | 4a | 12.7 | 0.16 | 500 | 63 | 12.6 |
| 68 | 4a | 23.6 | 0.15 | 500 | 68 | 13.6 |
| 69 | 4a | 28.8 | 0.17 | 500 | 65 | 13.0 |
| 70 | 4a | 31.1 | 0.15 | 500 | 60 | 12.0 |
| 71 | 4b | 11.3 | 0.11 | 500 | 71 | 14.2 |
| 72 | 4b | 19.4 | 0.13 | 500 | 75 | 15.0 |
| 73 | 4b | 24.6 | 0.11 | 505 | 78 | 15.4 |
| 74 | 4b | 29.2 | 0.13 | 500 | 66 | 13.2 |
| 75 | 4b | 33.5 | 0.12 | 500 | 70 | 14.0 |
| 76 | 4c | 10.1 | 0.15 | 500 | 65 | 13.0 |
| 77 | 4c | 17.5 | 0.15 | 500 | 61 | 12.2 |
| 78 | 4c | 19.8 | 0.17 | 500 | 58 | 11.6 |
| 79 | 4c | 29.1 | 0.16 | 500 | 54 | 10.8 |
| 80 | 4c | 32.5 | 0.15 | 500 | 69 | 13.8 |

UNDERLINES IN THE TABLE INDICATE THE VALUES FALL OUT OF THE SUITABLE RANGE SPECIFIED IN THE PRESENT INVENTION

TABLE 11

| No. | STEEL | TENSILE STRENGTH (MPa) | NUMBER OF CRACKS IN HOLE WALL PORTION (NUMBER) | DUCTILITY BRITTLENESS TRANSITION TEMPERATURE (° C.) | HOT STAMPING STATE |
|---|---|---|---|---|---|
| 66 | 4a | 1499 | 0 | −65 | GOOD |
| 67 | 4a | 1504 | 0 | −69 | GOOD |
| 68 | 4a | 1503 | 0 | −61 | GOOD |
| 69 | 4a | 1507 | 0 | −68 | GOOD |
| 70 | 4a | 1511 | 0 | −64 | Zn ADHERED |
| 71 | 4b | 1543 | 0 | −66 | GOOD |
| 72 | 4b | 1561 | 0 | −61 | GOOD |
| 73 | 4b | 1566 | 0 | −69 | GOOD |
| 74 | 4b | 1569 | 0 | −66 | GOOD |
| 75 | 4b | 1567 | 0 | −62 | Zn ADHERED |
| 76 | 4c | 1640 | 0 | −64 | GOOD |
| 77 | 4c | 1646 | 0 | −68 | GOOD |
| 78 | 4c | 1640 | 0 | −62 | GOOD |
| 79 | 4c | 1645 | 0 | −62 | GOOD |
| 80 | 4c | 1652 | 0 | −62 | Zn ADHERED |

In every example, the concentration of the Mn-containing inclusion and the number ratio of the Mn oxide to the Mn-containing inclusion having a maximum length of 1.0 to 4.0 μm fell within the range specified in the present invention, and therefore cracking did not occur in hole walls in the perforation test and the ductility brittleness transition temperature was −60° C. or lower, so that a steel sheet (member) having both hydrogen embrittlement resistance and toughness was obtained, but in samples Nos. 70, 75 and 80 in which the thickness of the galvanized layer was more than 30 μm, adhesion of Zn to the die occurred with high frequency. On the other hand, in samples Nos. 66 to 69, 71 to 74 and 76 to 79 in which the thickness of the galvanized layer was 30 μm or less, adhesion of Zn to the die did not occur at all.

Example 6

A steel piece having the chemical composition shown in Table 7 was formed into a 2.8 mm-thick hot-rolled steel sheet under the conditions same as those in Example 1, and the steel sheet was pickled, and then cold-rolled (draft: 50%) into a steel sheet having a sheet thickness of 1.4 mm. The cold-rolled steel sheet was heated to 655° C. at an average heating rate of 19° C./s, subsequently heated to 730 to 780° C. at an average heating rate of 2.5° C./s, immediately cooled at an average cooling rate of 6.5° C./s, immersed in a hot-dip galvanizing bath (containing Al in a concentration of 0.13%, Fe in a concentration of 0.03% and impurities) at 460° C., and taken out after 3 seconds. The deposition amount was adjusted with a gas wiper, the steel sheet was then heated to 480° C. form an alloyed hot-dip galvanized layer, and then air-cooled to room temperature. Analysis of the inclusion of the obtained steel sheet was performed in the same manner as in Example 1. In the same manner as in Example 2, the steel sheet was hot-stamped into a hat shape, and a JIS No. 5 tensile test piece, a piercing test piece and a Charpy impact test piece were taken from the hat portion. For heating conditions for hot stamping, the steel sheet was held at 900° C. for 1 minute, nitrogen containing hydrogen in a concentration of 3% was set as an atmosphere, and the dew point was set to 0° C. Analysis results related to the inclusion are shown in Table 12, and test results related to the hot stamp material are collectively shown in Table 13.

TABLE 12

| | | | | Mn-CONTAINING INCLUSION HAVING MAXIMUM LENGTH OF 1.0 TO 4.0 μm | | |
|---|---|---|---|---|---|---|
| No. | STEEL | THICKNESS OF Zn-Fe ALLOY LAYER (μm) | CONCENTRATION OF Mn-CONTAINING INCLUSION (% BY MASS) | NUMBER OF OBSERVED INCLUSIONS (NUMBER) | NUMBEROF Mn OXIDES (NUMBER) | NUMBER RATIO OF NUMBER OF Mn OXIDES (%) |
| 81 | 4a | 15.1 | 0.15 | 501 | 66 | 13.2 |
| 82 | 4a | 22.5 | 0.16 | 501 | 68 | 13.6 |
| 83 | 4a | 31.4 | 0.15 | 500 | 63 | 12.6 |
| 84 | 4a | 39.7 | 0.17 | 500 | 61 | 12.2 |
| 85 | 4a | 46.2 | 0.15 | 502 | 63 | 12.5 |
| 86 | 4b | 15.5 | 0.11 | 510 | 75 | 14.7 |
| 87 | 4b | 21.1 | 0.13 | 502 | 79 | 15.7 |
| 88 | 4b | 39.3 | 0.11 | 504 | 80 | 15.9 |
| 89 | 4b | 44.4 | 0.13 | 500 | 86 | 17.2 |
| 90 | 4b | 49.5 | 0.12 | 500 | 70 | 14.0 |
| 91 | 4c | 14.1 | 0.15 | 500 | 59 | 11.8 |
| 92 | 4c | 20.6 | 0.15 | 500 | 63 | 12.6 |
| 93 | 4c | 34.7 | 0.17 | 500 | 54 | 10.8 |

TABLE 12-continued

| No. | STEEL | THICKNESS OF Zn-Fe ALLOY LAYER (μm) | CONCENTRATION OF Mn-CONTAINING INCLUSION (% BY MASS) | Mn-CONTAINING INCLUSION HAVING MAXIMUM LENGTH OF 1.0 TO 4.0 μm: NUMBER OF OBSERVED INCLUSIONS (NUMBER) | NUMBEROF Mn OXIDES (NUMBER) | NUMBER RATIO OF NUMBER OF Mn OXIDES (%) |
|---|---|---|---|---|---|---|
| 94 | 4c | 42.1 | 0.16 | 504 | 59 | 11.7 |
| 95 | 4c | 45.4 | 0.15 | 500 | 60 | 12.0 |

UNDERLINES IN THE TABLE INDICATE THE VALUES FALL OUT OF THE SUITABLE RANGE SPECIFIED IN THE PRESENT INVENTION

TABLE 13

| No. | STEEL | TENSILE STRENGTH (MPa) | NUMBER OF CRACKS IN HOLE WALL PORTION (NUMBER) | DUCTILITY BRITTLENESS TRANSITION TEMPERATURE (° C.) | HOT STAMPING STATE |
|---|---|---|---|---|---|
| 81 | 4a | 1500 | 0 | −62 | GOOD |
| 82 | 4a | 1507 | 0 | −62 | GOOD |
| 83 | 4a | 1499 | 0 | −60 | GOOD |
| 84 | 4a | 1503 | 0 | −68 | GOOD |
| 85 | 4a | 1507 | 0 | −60 | VERY SMALL CRACKS GENERATED |
| 86 | 4b | 1569 | 0 | −67 | GOOD |
| 87 | 4b | 1614 | 0 | −66 | GOOD |
| 88 | 4b | 1619 | 0 | −69 | GOOD |
| 89 | 4b | 1612 | 0 | −63 | GOOD |
| 90 | 4b | 1608 | 0 | −60 | VERY SMALL CRACKS GENERATED |
| 91 | 4c | 1681 | 0 | −64 | GOOD |
| 92 | 4c | 1647 | 0 | −61 | GOOD |
| 93 | 4c | 1641 | 0 | −68 | GOOD |
| 94 | 4c | 1646 | 0 | −62 | GOOD |
| 95 | 4c | 1653 | 0 | −60 | VERY SMALL CRACKS GENERATED |

In every example, the concentration of the Mn-containing inclusion and the number ratio of the Mn oxide to the Mn-containing inclusion having a maximum length of 1.0 to 4.0 μm fell within the range specified in the present invention, and therefore cracking did not occur in hole walls in the piercing test and the ductility brittleness transition temperature was −60° C. or lower, so that a steel sheet (member) having both hydrogen embrittlement resistance and toughness was obtained, but in samples Nos. 85, 90 and 95 in which the thickness of the alloyed hot-dip galvanized layer was more than 45 μm, very small cracks were generated in the alloy layer after pressing. On the other hand, in samples Nos. 81 to 84, 86 to 89 and 91 to 94 in which the thickness of the alloyed hot-dip galvanized layer was 45 μm or less, very small cracks were not generated at all in the alloy layer after pressing.

INDUSTRIAL APPLICABILITY

According to the present invention, good hydrogen embrittlement resistance can be secured even when processing leading to remaining of stress, such as piercing, is performed after hot stamping, and practice is easy, so that the range of applications (components) of the hot stamping method can be expanded. Accordingly, the present invention is highly usable in steel sheet processing industries.

REFERENCE SIGNS LIST

21*a* upper die
21*b* lower die
22 steel sheet
41 test piece taking position

The invention claimed is:

1. A steel sheet for hot stamping, wherein the steel sheet comprises a chemical composition comprising:

C: 0.18 to 0.26%;
Si: more than 0.02% and not more than 0.05%;
Mn: 1.0 to 1.5%;
P: 0.03% or less;
S: 0.02% or less;
Al: 0.001 to 0.5%;
N: 0.1% or less;
O: 0.005 to 0.020%;
Cr: 0 to 2.0%;
Mo: 0 to 1.0%;
V: 0 to 0.5%;
W: 0 to 0.5%;
Ni: 0 to 5.0%;
B: 0 to 0.01%;
Ti: 0 to 0.5%;
Nb: 0 to 0.5%;
Cu: 0 to 1.0%; and balance: Fe and impurities, in terms of % by mass, the concentration of a Mn-containing inclusion is not less than 0.010% by mass and less than 0.25% by mass, and the number ratio of a Mn oxide to the inclusion having a maximum length of 1.0 to 4.0 μm is 10.0% or more.

2. The steel sheet for hot stamping according to claim 1, wherein the chemical composition comprises one or more selected from the group consisting of Cr: 0.01 to 2.0%;
Mo: 0.01 to 1.0%;
V: 0.01 to 0.5%;
W: 0.01 to 0.5%;
Ni: 0.01 to 5.0%; and
B: 0.0005 to 0.01%, in terms of % by mass.

3. The steel sheet for hot stamping according to claim 1, wherein the chemical composition comprises one or more selected from the group consisting of Ti: 0.001 to 0.5%;
Nb: 0.001 to 0.5%; and
Cu: 0.01 to 1.0%, in terms of % by mass.

4. The steel sheet for hot stamping according to claim 1, wherein the steel sheet comprises, on a surface thereof, an aluminum hot-dipping layer having a thickness of 50 μm or less.

5. The steel sheet for hot stamping according to claim 1, wherein the steel sheet comprises, on a surface thereof, a hot-dip galvanized layer having a thickness of 30 μm or less.

6. The steel sheet for hot stamping according to claim 1, wherein the steel sheet comprises, on a surface thereof, an alloyed hot-dip galvanized layer having a thickness of 45 μm or less.

7. A hot stamping steel material, wherein the hot stamping steel material comprises a chemical composition comprising:

C: 0.18 to 0.26%;
Si: more than 0.02% and not more than 0.05%;
Mn: 1.0 to 1.5%;
P: 0.03% or less;
S: 0.02% or less;
Al: 0.001 to 0.5%;
N: 0.1% or less;
O: 0.005 to 0.020%;
Cr: 0 to 2.0%;
Mo: 0 to 1.0%;
V: 0 to 0.5%;
W: 0 to 0.5%;
Ni: 0 to 5.0%;
B: 0 to 0.01%;
Ti: 0 to 0.5%;
Nb: 0 to 0.5%;
Cu: 0 to 1.0%; and
balance: Fe and impurities, in terms of % by mass, the concentration of a Mn-containing inclusion is not less than 0.010% by mass and less than 0.25% by mass, and the number ratio of a Mn oxide to the inclusion having a maximum length of 1.0 to 4.0 μm is 10.0% or more.

8. The hot stamping steel material according to claim 7, wherein the chemical composition comprises one or more selected from the group consisting of Cr: 0.01 to 2.0%; Mo: 0.01 to 1.0%; V: 0.01 to 0.5%; W: 0.01 to 0.5%; Ni: 0.01 to 5.0%; and B: 0.0005 to 0.01%, in terms of % by mass.

9. The hot stamping steel material according to claim 7, wherein the chemical composition comprises one or more selected from the group consisting of Ti: 0.001 to 0.5%; Nb: 0.001 to 0.5%; and Cu: 0.01 to 1.0%, in terms of % by mass.

10. The steel sheet for hot stamping according to claim 2, wherein the chemical composition comprises one or more selected from the group consisting of Ti: 0.001 to 0.5%;
Nb: 0.001 to 0.5%; and
Cu: 0.01 to 1.0%, in terms of % by mass.

11. The steel sheet for hot stamping according to claim 2, wherein the steel sheet comprises, on a surface thereof, an aluminum hot-dipping layer having a thickness of 50 μm or less.

12. The steel sheet for hot stamping according to claim 3, wherein the steel sheet comprises, on a surface thereof, an aluminum hot-dipping layer having a thickness of 50 μm or less.

13. The steel sheet for hot stamping according to claim 2, wherein the steel sheet comprises, on a surface thereof, a hot-dip galvanized layer having a thickness of 30 μm or less.

14. The steel sheet for hot stamping according to claim 3, wherein the steel sheet comprises, on a surface thereof, a hot-dip galvanized layer having a thickness of 30 μm or less.

* * * * *